US007058321B2

(12) United States Patent
Kin

(10) Patent No.: US 7,058,321 B2
(45) Date of Patent: Jun. 6, 2006

(54) DEVICE AND METHOD OF CALCULATING TONER CONSUMPTION, AND IMAGE FORMING APPARATUS USING THE SAME

(75) Inventor: Hidenori Kin, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/809,807

(22) Filed: Mar. 26, 2004

(65) Prior Publication Data

US 2004/0247330 A1 Dec. 9, 2004

(30) Foreign Application Priority Data

| | | |
|---|---|---|
| Mar. 27, 2003 | (JP) | P2003-087008 |
| Mar. 27, 2003 | (JP) | P2003-087009 |
| Apr. 2, 2003 | (JP) | P2003-098828 |
| Apr. 17, 2003 | (JP) | P2003-112374 |

(51) Int. Cl.
*G03G 15/08* (2006.01)

(52) U.S. Cl. ..... 399/27; 399/49

(58) Field of Classification Search ..... 399/29, 399/49, 27, 72, 58–60
See application file for complete search history.

(56) References Cited

U.S. PATENT DOCUMENTS

| | | | | |
|---|---|---|---|---|
| 6,393,228 | B1 * | 5/2002 | Hisano | 399/49 |
| 6,505,010 | B1 * | 1/2003 | Izumizaki et al. | 399/39 |
| 2002/0025173 | A1 * | 2/2002 | Isobe et al. | 399/12 |
| 2002/0044785 | A1 * | 4/2002 | Luxem | 399/49 |

FOREIGN PATENT DOCUMENTS

| | | | |
|---|---|---|---|
| JP | 07-032656 | A | 2/1995 |
| JP | 08-254861 | A | 10/1996 |
| JP | 2001-042579 | A | 2/2001 |
| JP | 2001-042729 | A | 2/2001 |
| JP | 2001042729 | * | 2/2001 |
| JP | 2002-174929 | A | 6/2002 |

* cited by examiner

*Primary Examiner*—Susan Lee
(74) *Attorney, Agent, or Firm*—Sughrue Mion, PLLC

(57) ABSTRACT

In a device for calculating a total amount of toner consumed from a toner cartridge, a first amount of the toner, which is consumed in a first region of a recording medium at which a toner image is formed, is obtained. A time period of which the toner cartridge is in operation is clocked. A second amount of the toner, which is consumed in a second region of the recording medium at which the toner image is not formed, is stored in advance. The second amount is associated with the time period. The second amount is added to the first amount in accordance with the clocked time period, in order to obtain the total amount.

28 Claims, 9 Drawing Sheets

FIG. 4

| COLOR | OFFSET VALUE |
|---|---|
| K | a1 |
| C | a2 |
| M | a3 |
| Y | a4 |

FIG. 5

| COLOR | OFFSET VALUE |
|---|---|
| K | b1 |
| C | b2 |
| M | b3 |
| Y | b4 |

FIG. 6

| COLOR | OFFSET VALUE | |
|---|---|---|
| | MAIN CONTROLLER | ENGINE CONTROLLER |
| K | c1 | d1 |
| C | c2 | d2 |
| M | c3 | d3 |
| Y | c4 | d4 |

DEVICE AND METHOD OF CALCULATING TONER CONSUMPTION, AND IMAGE FORMING APPARATUS USING THE SAME

BACKGROUND OF THE INVENTION

The present invention relates to a device and method of calculating the amount of toner consumption with high accuracy so that the actual amount of consumption can be ascertained. The present invention also relates to an image forming apparatus using such a device and a method.

An image forming apparatus which forms an image through use of toner must manage the life of a toner cartridge by ascertaining the amount of toner consumption or the amount of remaining toner in order to facilitate maintenance, such as toner replenishment, or preservation of image quality. Japanese Patent Publication No. 2002-174929A discloses a method for calculating toner consumption with simple configuration which enable accurate determination of toner consumption.

A relationship between the number of a printed dot and the amount of toner consumption is nonlinear, and the relationship also changes depending on the state of another printed dot adjacent to that printed dot. In light of this relationship, the method classifies a train of printed dots into three patterns; that is, an isolated dot, two consecutive dots, and an dot of intermediate value. The number of dots formed is counted on a per-pattern basis. The amount of toner consumption is determined on the basis of the counted values.

In such an image forming apparatus, the toner filled in the toner cartridge is gradually consumed and decreased as a result of repeated formation of an image. When the amount of toner filled in the cartridge has decreased to a certain level or less, a message "Please replace the toner cartridge" appears on a display of the image forming apparatus, thereby alerting the user.

Even in view of effective utilization of resources, the user desires to accurately recognize the amount of toner consumption and replace a toner cartridge at an appropriate time. This publication teaches a pattern into which a train of printed dots is arranged is classified into three categories. There is disclosed determination of the amount of toner consumed per page during a certain job period on the basis of the pattern in which a train of printed dots is arranged. Specifically, the amount of toner actually consumed by an image formation area of a recording medium is detected, and the amount of toner consumption is subtracted from a toner initial value filled in the toner cartridge, thereby determining the amount of remaining toner. However, the image forming apparatus is susceptible to occurrence of a "fogging" phenomenon; that is, adhesion of toner to a non-image formation area (white background) of a recording medium other than the image formation area.

Therefore, in order to manage the life of a toner cartridge by ascertaining the amount of toner remaining in the image forming apparatus, the amount of toner consumed by fogging as well as the amount of toner consumed by the image formation area must be taken into consideration. However, this publication fails to describe means for determining the amount of toner consumed by fogging. Therefore, this technique suffers a problem of inability to appropriately calculate the toner consumption with high accuracy.

However, if variations have arisen in the amount of toner transferred to an image carrier in an image forming apparatus which superposes toner images of multiple colors on the image carrier, the electric potentials of exposed portions vary in the next color process, thereby requiring a stricter control operation. Moreover, there may be a case where the density of an image varies for reasons of fatigue in a photosensitive member, a time-varying change in toner, and variations in the temperature and humidity of a neighborhood of the apparatus. Therefore, there has hitherto been proposed a technique for stabilizing the density of an image by controlling a density control factor which affects the density of a toner image; e.g., a charging bias, a development bias, and the amount of exposure, as required.

Such a technique is for controlling an operation for supplying toner to the inside of a development device or consumption of toner in the development device, by forming a patch toner image on an image carrier and optically measuring the density of the patch image through use of a sensor. For instance, Japanese Patent Publication No. 2001-42579A describes an image forming apparatus comprising: a charger for charging the surface of a photosensitive member; an exposer for forming an electrostatic latent image on the surface of the photosensitive member; a developer for forming a toner image by rendering the electrostatic latent image visible with toner; a density detector for detecting the density of an image by taking, as a patch image, the toner image formed on the photosensitive member by the developer or the toner image formed as a result of transfer of the toner image of a transfer medium; and a controller for controlling the density of the toner image to a target level on the basis of a result of detection performed by the density detector, wherein the patch image is formed from a plurality of single dot lines spaced apart from each other.

As mentioned above, in the image forming apparatus, a patch image to be used for controlling density is prepared as a preparing operation prior to formation of an image in the image formation area. Toner is also consumed even at the time of formation of the patch image. However, according to the prior art, even when the amount of toner consumption is sought, no consideration has been paid to the amount of toner consumed to form the patch image. Therefore, there is a problem of a failure to appropriately calculate the amount of toner consumption with high accuracy. There is another problem of a failure to accurately manage the life of the toner cartridge.

In the image forming apparatus of this type, if an offset exists in positions, where images of different colors are to be transferred, during transfer of an image on a recording medium, a color displacement arises, to thereby deteriorate image quality. In order to correct such a color displacement, Japanese Patent Publication No. 7-32656A discloses formation of a registration mark to a paper transport belt (i.e. a member for moving a recording member).

The image forming apparatus is further provided with a cleaning blade for removing the toner still remaining on the image carrier (i.e., the photosensitive member). If pressure at which a cleaning blade comes into contact with the image carrier is too large, the cleaning blade will vibrate, thereby failing to perform cleaning operation properly. For these reasons, there is a problem of deterioration of image quality, which is caused when toner remains on the image carrier. To solve the problem, Japanese Patent Publication No. 2001-42729A describes prevention of vibration of the cleaning blade by accumulating, at all times, toner at a position immediately below an area where the image carrier comes into contact with the cleaning blade, thereby causing the toner to act as a lubricant. Although not described in this publication, there is a conceivable method for previously imparting toner to be used for preventing vibration of the cleaning blade, with a view toward rendering image quality stable by rendering contact between the photosensitive member and the cleaning blade smooth in the initial state of the image forming apparatus achieved at shipment from a factory.

As mentioned above, the image forming apparatus uses toner in an application other than the application for formation of an image in an image formation area. Specifically, toner is imparted to a predetermined area, such as the neighborhood of an area where the paper transport belt or the image carrier comes into contact with the cleaning blade, with a view toward achievement of stable image quality. However, this technique does not take into consideration the amount of toner consumed at a predetermined position for achieving image quality, which has already been described, at the time of determination of the amount of toner consumption. Therefore, there has been a problem of a failure to appropriately and accurately calculate the amount of toner consumption. There is also a problem of a failure to accurately manage the life of the toner cartridge.

Japanese Patent Publication No. 2001-42579A describes formation of a solid image patch (a Vdc patch) as a technique for rendering the density of an image stable by controlling a density control factor which affects the density of the toner image; e.g., a charging bias, a development bias, and the amount of exposure, as required. Moreover, forming a fine-line patch (E patch) as a patch image to be used for controlling density in conjunction with a solid image is also known. The fine-line patch is formed by a so-called "one-on ten-off" method, wherein, e.g., a patch image corresponding to one line is formed, and no image is formed in an area corresponding to ten lines in a secondary scanning direction.

The image forming apparatus described in this publication is equipped with a main controller having an image memory for storing image data to be transmitted from an external calculator, and an engine controller for controlling an image formation section (engine) in accordance with a signal output from the main controller. Moreover, the previously-described image patch is described as being prepared by a patch generation module of the engine controller. That is, the density pattern of an image is determined by the engine controller.

In the image forming apparatus of this type, the density and line width of the toner image vary in accordance with the temperature and humidity of an image environment or the number of times the image carrier and a developing agent have been used. For this reason, a patch image called a gradation patch is formed, thereby measuring the density of the patch image and determining a density control pattern. Japanese Patent Publication No. 8-254861A describes writing of a gradation pitch into a RAM of a control circuit (main controller). That is, the density control pattern is determined by the main controller.

As mentioned previously, before forming an image in the image formation area, the image forming apparatus forms a patch image to be used for controlling a density as a preparing operation. The patch image is separated into an image of gradation patch prepared by the main controller, and a solid image and a fine-line patch image, which are prepared by the engine controller, and the images are stored in the respective storages. However, neither the main controller nor the engine controller is given information about a patch image prepared by the counterpart controller. For this reason, the total amount of toner consumed by an overall patch image is not recognized.

As mentioned above, toner is consumed even when a patch image is formed. However, according to these techniques, at the time of determination of the amount of toner consumption, no consideration has been paid to the amount of toner consumed by the main controller to form the gradation patch image and the amount of toner consumed by the engine controller to form the fine-line patch image. Therefore, there has been a problem of a failure to accurately and appropriately calculate the amount of toner consumption. Moreover, there is a problem of a failure to accurately manage the life of the toner cartridge.

SUMMARY OF THE INVENTION

It is therefore an object of the invention to provide a device and a method for attaining accurate calculation of toner consumption so that the actual amount of toner consumption can be ascertained. It is also an object of the invention to provide an image forming apparatus using such a device and a method.

In order to achieve the above objects, according to the invention, there is provided a device for calculating a total amount of toner consumed from a toner cartridge, the device comprising:

a counter, which obtains a first amount of the toner, which is consumed in a first region of a recording medium at which a toner image is formed;

a timer, which clocks a time period of which the toner cartridge is in operation;

a storage, which stores in advance a second amount of the toner, which is consumed in a second region of the recording medium at which the toner image is not formed, the second amount being associated with the time period; and a calculator, which adds the second amount to the first amount in accordance with the clocked time period, in order to obtain the total amount.

According to the invention, there is also provided a device for calculating a total amount of toner consumed from a toner cartridge, the device comprising:

a counter, which obtains a first amount of the toner, which is consumed in a first region of a recording medium at which a toner image is formed;

a storage, which stores in advance a second amount of the toner, which is consumed by forming a test image; and a calculator, which adds the second amount to the first amount, in order to obtain the total amount.

According to the invention, there is also provided a device for calculating a total amount of toner consumed from a toner cartridge, the device comprising:

a counter, which obtains a first amount of the toner, which is consumed in a first region of a recording medium at which a toner image is formed;

a storage, which stores in advance a second amount of the toner, which is consumed for a purpose other than the formation of the toner image on the recording medium; and a calculator, which adds the second amount to the first amount, in order to obtain the total amount.

Preferably, the second amount of the toner includes a toner used for forming a registration mark for placing the recording medium at a predetermined position.

Preferably, the second amount of the toner includes a toner used for stabilizing vibrations of a cleaning blade abutted against a toner carrier.

In the above devices, it is preferable that: a plurality of colors of toner are used to form the toner image; and the second amount is individually determined for each of the colors. Here, the calculation is performed more accurately.

According to the invention, there is also provided a device for calculating a total amount of toner consumed from a toner cartridge, the device comprising:

a counter, which obtains a first amount of the toner, which is consumed in a first region of a recording medium at which a toner image is formed;

a first storage, which stores in advance a second amount of the toner, which is consumed for forming a first test image;

a second storage, which stores in advance a third amount of the toner, which is consumed for forming a second test image; and a calculator, which adds the second amount and the third amount to the first amount, in order to obtain the total amount.

Preferably, the first test image is a gradation image, and the second test image includes at least a solid image.

Preferably, the first storage is provided in a first controller which receives an image signal from an external device, and the second storage is provided in a second controller which controls the formation of the toner image based on an instruction from the first controller.

In this case, since the second amount and the third amount (offset values) are stored in the different storages, there is less anxiety that both of the offset values are simultaneously lost. Accordingly, the security for the stored offset values can be enhanced.

Preferably, a plurality of colors of toner are used to form the toner image; and the second amount and the third amount are individually determined for each of the colors. Here, the calculation is performed more accurately.

According to the invention, there is also provided a method for calculating a total amount of toner consumed from a toner cartridge, the method comprising steps of:

obtaining a first amount of the toner, which is consumed in a first region of a recording medium at which a toner image is formed;

clocking a time period of which the toner cartridge is in operation;

storing in advance a second amount of the toner, which is consumed in a second region of the recording medium at which the toner image is not formed, the second amount being associated with the time period; and adding the second amount to the first amount in accordance with the clocked time period, in order to obtain the total amount.

According to the invention, there is also provided a method for calculating a total amount of toner consumed from a toner cartridge, the method comprising steps of:

obtaining a first amount of the toner, which is consumed in a first region of a recording medium at which a toner image is formed;

storing in advance a second amount of the toner, which is consumed by forming a test image; and adding the second amount to the first amount, in order to obtain the total amount.

According to the invention, there is also provided a method for calculating a total amount of toner consumed from a toner cartridge, the method comprising steps of:

obtaining a first amount of the toner, which is consumed in a first region of a recording medium at which a toner image is formed;

storing in advance a second amount of the toner, which is consumed for a purpose other than the formation of the toner image on the recording medium; and adding the second amount to the first amount, in order to obtain the total amount.

Preferably, the second amount of the toner includes a toner used for forming a registration mark for placing the recording medium at a predetermined position.

Preferably, the second amount of the toner includes a toner used for stabilizing vibrations of a cleaning blade abutted against a toner carrier.

In the above methods, it is preferable that: a plurality of colors of toner are used to form the toner image; and the second amount is individually determined for each of the colors.

According to the invention, there is also provided a method for calculating a total amount of toner consumed from a toner cartridge, the method comprising steps of:

obtaining a first amount of the toner, which is consumed in a first region of a recording medium at which a toner image is formed;

storing in advance a second amount of the toner, which is consumed for forming a first test image;

storing in advance a third amount of the toner, which is consumed for forming a second test image; and adding the second amount and the third amount to the first amount, in order to obtain the total amount.

Preferably, the first test image is a gradation image, and the second test image includes at least a solid image.

Preferably, a plurality of colors of toner are used to form the toner image; and the second amount and the third amount are individually determined for each of the colors.

According to the invention, there is also provided an image forming apparatus, comprising:

the above device for calculating the consumed amount of the toner;

a storage, which stores a remaining amount of the toner in the toner cartridge, the remaining amount is calculated by subtracting the total amount calculated by the calculator from an initial amount of the toner; and a judge, which judges a time at which the toner cartridge is replaced, in a case where the remaining amount becomes a predetermined value or less.

Preferably, the predetermined value is selected from a plurality of values one of which is substantially zero.

Preferably, the predetermined value is varied in accordance with a rate of an area of the toner image relative to the recording medium.

Preferably, the predetermined value is individually determined for each of a plurality of toner cartridges having different volumes.

In such configurations, since the total amount of the toner consumed from the toner cartridge is accurately calculated, also the life of the toner cartridge can be determined accurately.

BRIEF DESCRIPTION OF THE DRAWINGS

The above objects and advantages of the present invention will become more apparent by describing in detail preferred exemplary embodiments thereof with reference to the accompanying drawings, wherein:

FIGS. 4 through 6 show examples of a table for setting offset values of the toner consumption;

DETAILED DESCRIPTION OF THE INVENTION

Figure 7:
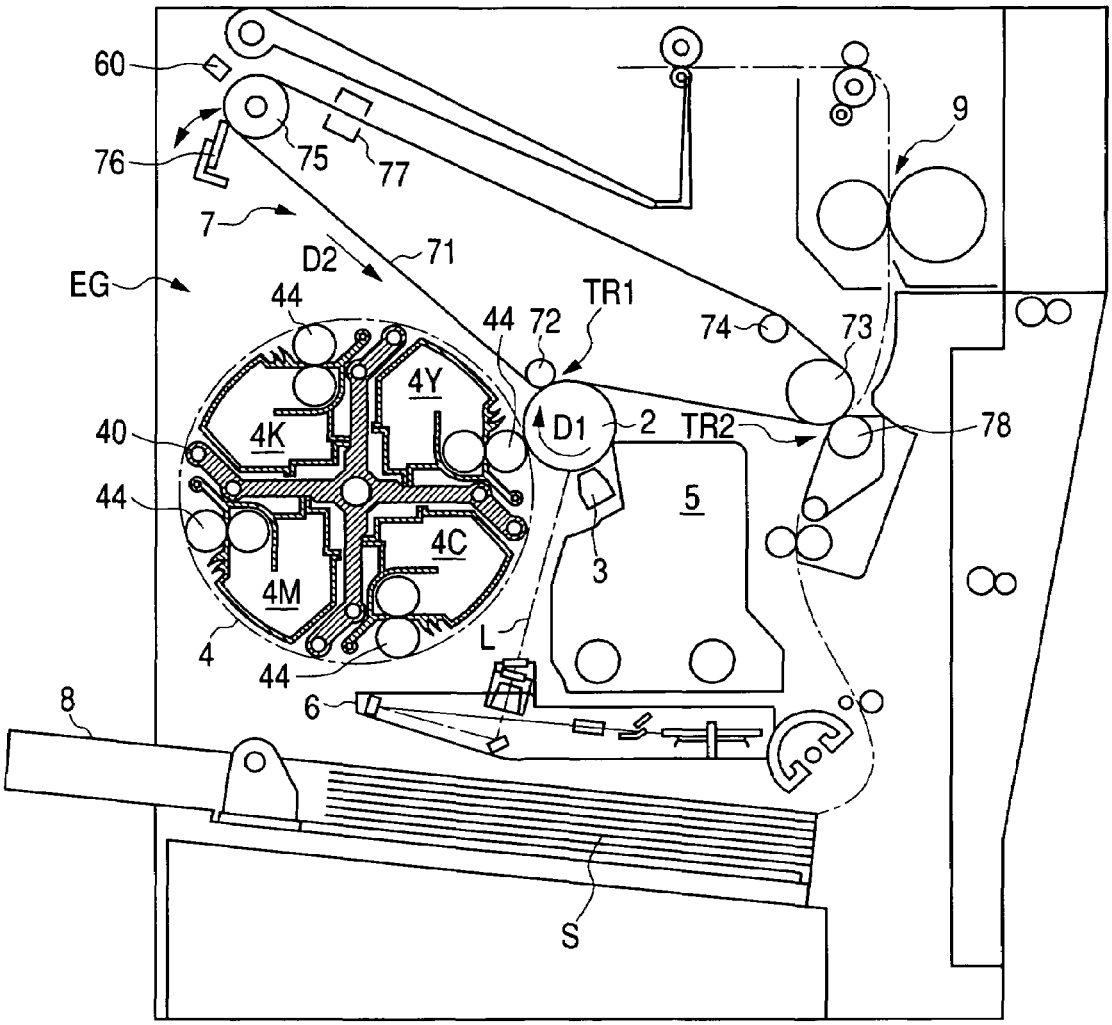
FIG. 7 is a section view showing an image forming apparatus.

Preferred embodiments of the present invention will be described hereinbelow in detail with reference to the accompanying drawings. An image forming apparatus shown in FIG. 7 is for forming a full-color image by superposing four-color images; that is, a yellow (Y) toner image, a cyan (C) toner image, a magenta (M) toner image, and a black (K) toner image, and a monochrome image through use of only the black (K) toner image. In the image forming apparatus of the present invention, an image signal is inputted to a main controller 11 from an external apparatus such as a host computer in accordance with a user's request for forming an image. At this time, an instruction signal is transmitted from the main controller 11 to an engine controller 10. In accordance with the instruction signal, the engine controller 10 controls individual sections of an engine section EG, thereby forming on a sheet S (recording medium) an image corresponding to the image signal.

This engine section EG is provided with a photosensitive member 2 serving as an image carrier, such that the photosensitive member is rotatable in the direction of an arrow D1 shown in FIG. 7. A charger 3, a rotary developer 4, and a cleaner 5 are provided around the photosensitive member 2 along the rotating direction D1 thereof. A charging bias output from a charging controller 103 is applied to the charger 3, thereby uniformly charging an outer peripheral surface of the photosensitive member 2 to a predetermined surface potential. A light beam L is emitted from an exposer 6 toward the outer peripheral surface of the photosensitive member 2 charged by the charger 3. In accordance with a control instruction issued by an exposure controller 102, the exposer 6 irradiates the photosensitive member 2 with the light beam L, thereby forming an electrostatic latent image corresponding to an image signal. The exposer 6 is provided with optical elements, such as a lens, a mirror, or the like, as required.

When an image signal is delivered from an external apparatus, such as a host computer, to a CPU 111 of the main controller 11 by way of an interface 112, a CPU 101 of the engine controller 10 outputs, to the exposure controller 102 and at a predetermined timing, a control signal corresponding to the image signal. The light beam L is radiated from the exposer 6 on the photosensitive member 2 in accordance with this control signal, whereupon an electrostatic latent image corresponding to the image signal is formed on the photosensitive member 2. The thus-formed electrostatic latent image is subjected to toner development by the rotary developer 4. Specifically, in the present embodiment, the rotary developer 4 is equipped with a support frame 40 which is provided so as to be rotatable about the axial center; and another member, such as a rotary driver omitted from the drawing. The rotary developer 4 is further provided with an yellow developing section 4Y, a cyan developing section 4C, a magenta developing section 4M, and a black developing section 4K, which are detachably installed in the support frame 40 and accommodate colors of toner (the color developing sections 4Y, 4C, 4M, and 4K are herein sometimes called "toner cartridges").

Figure 9:
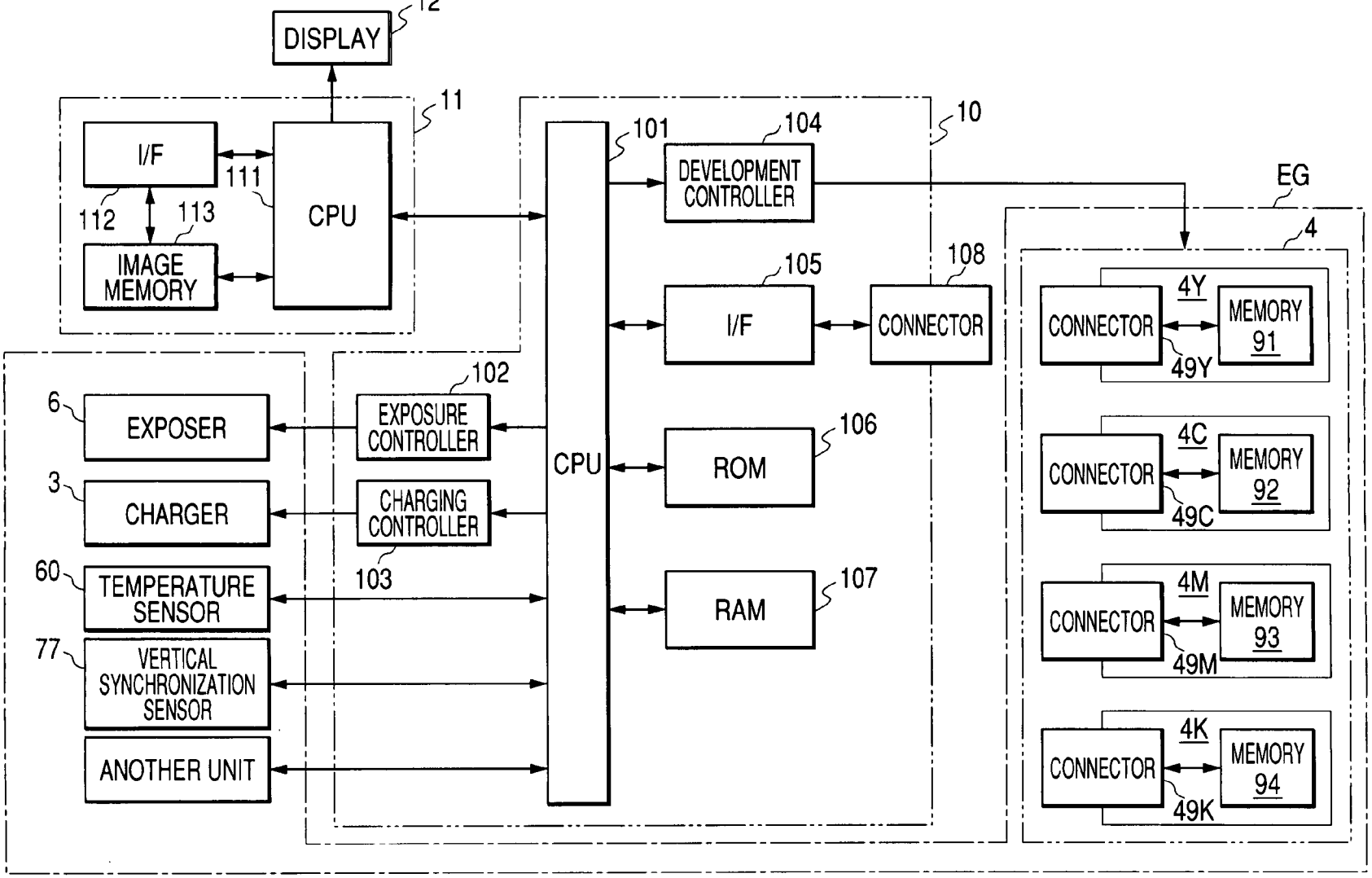
FIG. 9 is a block diagram showing an electrical configuration of the image forming apparatus of FIG. 7.

As shown in FIG. 9, the rotary developer 4 is controlled by a development controller 104. In accordance with a control instruction output from the development controller 104, the rotary developer 4 is rotatively driven. The developing sections 4Y, 4C, 4M, and 4K are selectively placed at predetermined development positions opposing to the photosensitive member 2, thereby imparting a selected color of toner to the surface of the photosensitive member 2. As a result, the electrostatic latent image on the photosensitive member 2 is rendered visible in the selected color of toner. Before forming an image in an image formation area, the rotary developer 4 forms patch images of respective colors. The patch images include patches of solid images (Vdc patches) and fine line patches (E patches). A fine line patch is prepared in a so-called "one-on ten-off" format, in which, for example, one line of patch image is formed and no image is formed in an area corresponding to ten lines in a secondary scanning direction.

The main controller 11 forms gradation patch images for determining a density control pattern. The gradation patch is formed by placing a single color or superposing a plurality of colors on the image carrier. In the present embodiment of the invention, the amount of toner consumed by preparing patch images, which are formed separately as a first patch image prepared by the engine controller 10 and a second patch image prepared by the main controller 11, is stored in a storage as an offset value beforehand. The offset value is added to the amount of toner consumed in the image formation area, thereby determining the amount of toner consumed by the entire image forming apparatus.

The developing section controller 104 is provided with a timer for clocking an operated time of each of the development rollers. The time clocked by the timer is input to the CPU 101. The CPU 101 is equipped with a counter for counting the time clocked by the timer, thereby accumulating the clocked time. As will be described later, an offset value of the amount of toner consumption corresponding to fogging, which is equivalent to one second of the operated time of the development roller, is registered beforehand in a memory. The offset value is added to the amount of toner consumption in accordance with the operated time of the development roller. The timer for clocking the operated time of the development roller can also be embodied by a program timer provided in the CPU 101.

A development roller 44 provided on the developing section is placed at the development position (i.e., the yellow developing section 4Y in the embodiment shown in FIG. 7) and comes into contact with the photosensitive member 2 or is arranged so as to oppose the photosensitive member 2 with a predetermined gap therebetween. The development roller 44 serves as a toner carrier for carrying the frictionally-charged toner to the surface of the photosensitive member 2. As the development roller 44 rotates, the toner is sequentially transported to the position where the development roller 44 opposes the photosensitive member 2 having an electrostatic latent image formed thereon. Here, the developing section controller 104 applies, to the development roller 44, a development bias on which a DC voltage and an AC voltage are superposed. By such a development bias, the toner carried by the development roller 44 partially adheres to individual sections of the surface of the photosensitive member 2 in accordance with the surface potentials of the sections, whereby the electrostatic latent image formed on the photosensitive member 2 is rendered visible as a toner image of the toner color.

The toner image developed by the developer 4 in the manner mentioned above is transferred to an intermediate transfer belt (an intermediate transfer member) 71 of a transferor 7 in a primary transfer area TR1 through primary transfer. The transferor 7 comprises the intermediate transfer belt 71 suspended by a plurality of rollers 72 to 75; and a drive section (not shown) for circulating the intermediate transfer belt 71 in a predetermined rotating direction D2 by rotating the roller 73. Moreover, a secondary transfer roller 78, which is retractably brought into contact with the surface of the belt 71 by an unillustrated electromagnetic clutch, is disposed at a position which opposes the roller 73 with the intermediate transfer belt 71 interposed therebetween. When a color image is transferred to a sheet S (recording medium), the toner images of respective colors formed on the photosensitive member 2 are superposed on the intermediate transfer belt 71, to thereby form a color image. A color image is transferred onto the sheet S which is taken out of a cassette 8 and conveyed to a secondary transfer area TR2 between the intermediate transfer belt 71 and a secondary transfer roller 78. Moreover, the sheet having the color image formed thereon is transported to an output tray section provided on a top section of a main body of the apparatus by way of a fixer 9.

The surface potential of the photosensitive member 2 that has transferred the toner image on the intermediate transfer belt 71 through primary transfer operation is reset by a discharger omitted from the drawing. After the toner remaining on the surface of the photosensitive member 2 has been removed by the cleaner 5, the photosensitive member 2 is subjected to the next charging by the charger 3. The toner removed by the cleaner 5 is recovered by an unillustrated toner tank. A cleaner 76, a density sensor 60, and a vertical synchronization sensor 77 are arranged in the vicinity of the roller 75. Of these elements, the cleaner 76 can be retractably brought into close contact with the roller 75 by an unillustrated electromagnetic clutch. A blade of the cleaner 76 comes into contact with the surface of the intermediate transfer belt 71 passed around the roller 75 with the cleaner 76 having moved to the roller 75, thereby removing the toner still remaining on and adhering to the outer peripheral surface of the intermediate transfer belt 71 after secondary transfer operation. The toner removed by the blade of the cleaner 76 is recovered by a waste toner tank (not shown).

The vertical synchronization sensor 77 is a sensor for detecting the reference position of the intermediate transfer belt 71. The vertical synchronization sensor 77 is a sensor for acquiring a synchronization signal output in association with circulation of the intermediate transfer belt 71; that is, a vertical synchronization signal Vsync. In this apparatus, operations of the individual sections of the apparatus are controlled in accordance with the vertical synchronization signal Vsync in order to make operation timings of the individual sections coincide with each other and accurately superpose the toner images formed in respective colors on each other. The density sensor 60 is disposed so as to oppose to the surface of the intermediate transfer belt 71. In the density control operation, the optical density of the patch image formed on the outer peripheral surface of the intermediate transfer belt 71 is measured.

As shown in FIG. 9, the respective developing sections (toner cartridges) 4Y, 4C, 4M, and 4K are equipped with memory devices 91 to 94 for storing data pertaining to a manufacturing lot of the developing sections, the history of use of the developing sections, and the amount of toner remaining in the developing sections. The respective developing sections 4Y, 4C, 4M, and 4K are provided with connectors 49Y, 49C, 49M, and 49K. The connectors 49Y, 49C, 49M, and 49K are selectively connected to a connector 108 provided on the main body, as required. Therefore, data are exchanged between the CPU 101 of the engine controller 10 and the memory devices 91 to 94 by way of an interface 105, thereby managing various information items such as consumable item management of the developing sections (i.e., the cartridges). In this embodiment, the connector 108 of the main body and the connector 49K of the developing section are mechanically fitted together, thereby mutually exchanging data. However, data may be exchanged in a non-contact manner through use of, e.g., electromagnetic means such as radio communication.

The memory devices 91 to 94 for storing data unique to the respective developing sections 4Y, 4C, 4M, and 4K are preferably nonvolatile memory devices capable of storing data even while the memory devices remain in a powered off state or even while the developing sections are removed from the main body. For instance, a flash memory, a ferroelectric memory (FRAM, Ferroelectric Random Access Memory), or an EEPROM can be used as such nonvolatile memory. Although omitted from FIG. 7, the image forming apparatus is provided with a display 12 (FIG. 9). A predetermined message is displayed in accordance with a control instruction issued by the CPU 111, as required, thereby informing the user of required information. For instance, in the event that an anomaly, such as a failure in the apparatus or a paper jam, has arisen, a message for informing the user of occurrence of the anomaly is displayed. Alternatively, when the amount of toner remaining in any of the developing sections has decreased to a predetermined level or less; e.g., a near-end level to be described later, a message for announcing the approach of a time for replacement of the developing sections is displayed.

A display device; e.g., a liquid-crystal display or the like, can be used as the display 12. In place of the display device, a warning lamp which is illuminated or caused to blink may also be employed when necessary. Moreover, a warning device, which issues sound, such as a previously-recorded voice message or beep sound, other than visual information of a message to the user through display of the message may be employed, or the warning lamp and the warning device may be used in combination, if necessary. The controller 11 is provided with image memory 113 for storing an image output from an external apparatus such as a host computer, by way of the interface 112. Reference numeral 106 designates a ROM for storing a calculating program to be executed by the CPU 101 and control data to be used for controlling the engine section EG. Reference numeral 107 designates a RAM for temporarily storing results of calculating operation performed by the CPU 101 and other data. As mentioned previously, a nonvolatile FRAM may be employed for the RAM 107.

Figure 8:
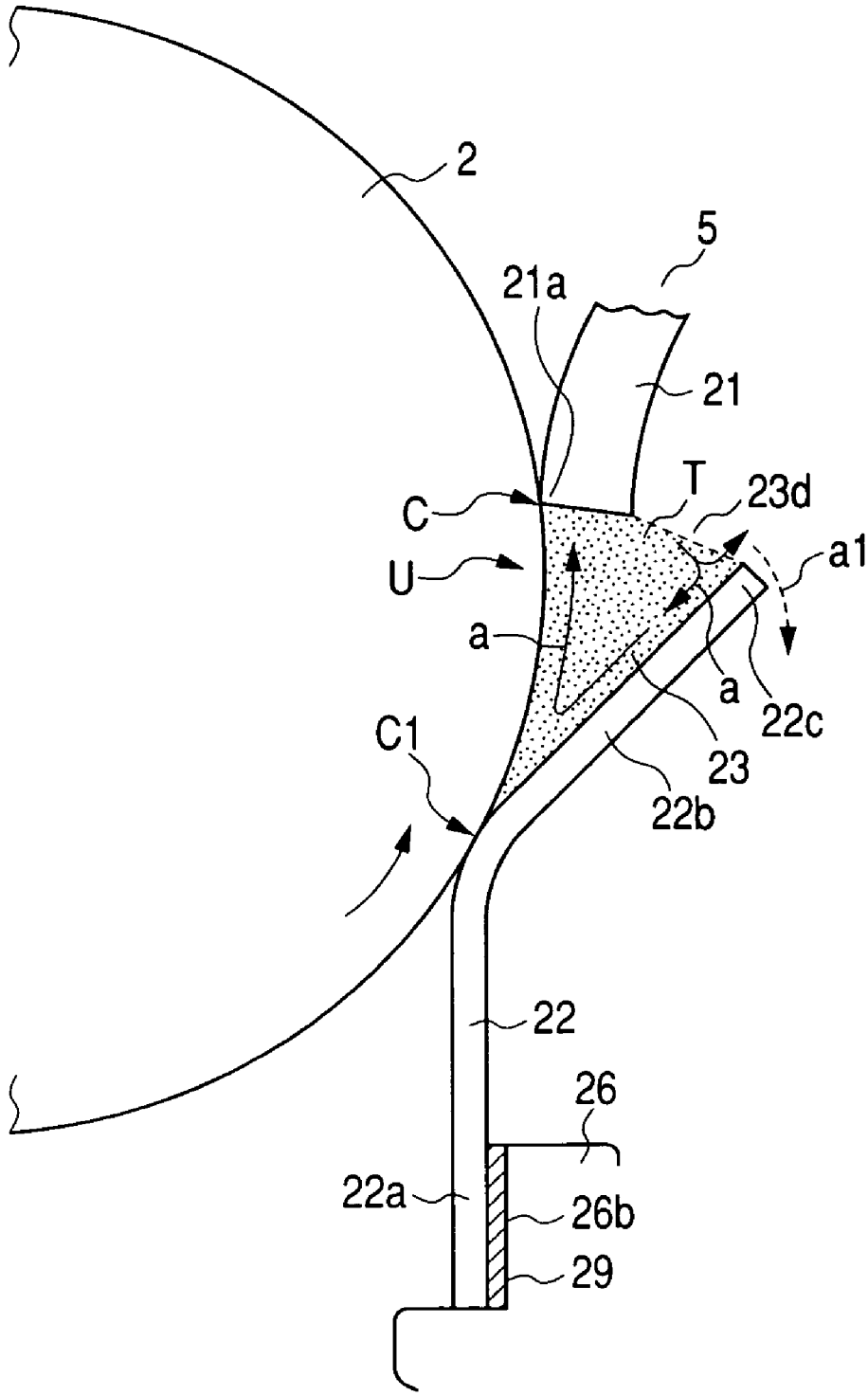
FIG. 8 is an enlarged view showing a distal end portion of a cleaning blade in the image forming apparatus of FIG. 7.

FIG. 8 is a fragmentary enlarged view of the cleaner 5 shown in FIG. 7. In FIG. 8, the cleaner 5 is provided with a cleaning blade 21 for scraping the toner adhering to the outer peripheral surface of the photosensitive member 2 (residual toner) after transfer of the toner image on the intermediate transfer belt 71. The cleaner 5 is additionally provided with a catch sheet 22 for catching the toner T which falls as a result of being scraped by the blade 21, and a deposition space 23 for depositing the falling toner. As clearly shown in FIG. 8, an extremity section 22*c* of the catch sheet 22 extends while being spaced apart from the surface of the photosensitive member 2, and an extended section 22*b* of the catch sheet 22 constitutes a toner accumulation section for accumulating, at all times, the toner T scraped by the cleaning blade 21 at a contact section C existing between the photosensitive member 2 and the cleaning blade 21 and at a section U located immediately below the contact section C. By the deposition space 23, the toner T scraped by the cleaning blade 21 is accumulated on the contact section C located between the photosensitive member 2 and the cleaning blade 21 and on the section U located immediately below the contact section C.

The catch sheet 22 extends in the direction orthogonal to the plane of paper, and the deposition space 23 is provided at a position below the contact section C over the entire length thereof. A gap 23*d* is defined between the extremity section (upper end section) 22*c* of the catch sheet 22 and the cleaning blade 21, and an excessive amount of toner of the toner T accumulated in the accumulation section 23 flows into an unillustrated receiving section by way of the gap 23*d*. A lower section 22*a* of the catch sheet 22 is fixed to a mount surface 26*b* of a case 26 by an adhesive layer (e.g., an adhesive) 29, whereby the catch sheet 22 remains in contact with the photosensitive member 2 by elastic force of the catch sheet 22. The contact section is indicated by reference symbol C1. The catch sheet 22 remains in contact with the photosensitive member 2 at a position between the extremity section 22*c* and the lower section 22*a* of the catch sheet 22, and a portion of the catch sheet 22 located above the contact section C1 constitutes the toner accumulation section 22*b*. In other words, in the catch sheet 22 of the embodiment, the portion located below the extremity section 22*c* is brought into contact with the photosensitive member 2, thereby constituting the toner accumulation section 22*b*. Consequently, the toner accumulation section 22*b* is formed such that the gap between the surface of the photosensitive member 2 and the toner accumulation section 22*b* becomes gradually larger in the upward direction.

Since the catch sheet 22 remains in contact with the photosensitive member 2: the catch sheet 22 minutely vibrates in accordance with rotation of the photosensitive member 2. As indicted by an arrow "a" shown in FIG. 8, the toner T accumulated by operation of the toner accumulation section 22*b* circulates clockwise in accordance with the rotating direction (i.e., the counterclockwise direction in FIG. 8) of the photosensitive member 2. At this time, toner of relatively small particle size becomes likely to be supplied to the contact section C existing between the photosensitive member 2 and the cleaning blade 21 by the minute vibrating action. In detail, the excessive toner which has not been taken into the deposition space 23 during the course of circulation of the accumulated toner T flows to the receiving section as indicated by arrow a1. As a result of the photosensitive member 2 and the catch sheet 22 minutely vibrating, toner of relatively large particle size becomes likely to gather to a position above the deposition space 23. Therefore, most of the toner flooding to the receiving section as indicated by arrow a1 corresponds to toner of large particle size (i.e., toner of large particle size flows with high priority). Consequently, the toner of relatively small particle size remains in the deposition space 23. Therefore, the toner of relatively small particle size becomes likely to be supplied to the contact section C existing between the photosensitive member 2 and the cleaning blade 21.

The cleaning device such as that mentioned above is constituted as a unit by the case 26 and is removably attached to an unillustrated frame of the main body of the image forming apparatus. According to the present invention, in a new product image forming apparatus, toner has previously been imparted to a cleaning device such as that shown in FIG. 8, thereby preventing vibration of the cleaning blade, which would otherwise be caused when the image forming apparatus is initially driven. Therefore, removal of residual toner of the photosensitive member by the cleaning blade in subsequent operation can be performed stably, thereby preventing deterioration of image quality.

There will now be describe the manner of determining the amount of remaining toner in the respective developing sections (i.e., toner cartridges) 4Y, 4M, 4C, and 4K in the image forming apparatus having the foregoing configuration. In relation to the image forming apparatus of this type, there has already been developed a single image forming apparatus which enables replacement and loading of toner cartridges having two different volumes; that is, a toner cartridge accommodating a large amount of toner and another cartridge accommodating a small amount of toner. In such a case, the life of the toner cartridge varies according to the amount of toner accommodated in the large toner cartridge or the amount of toner accommodated in the small toner cartridge. Specifically, in relation to a single color, a predetermined amount of remaining toner determined to constitute a time for replacement of a toner cartridge is set differently on the basis of whether the toner cartridge has a large or a small.

Figure 2:
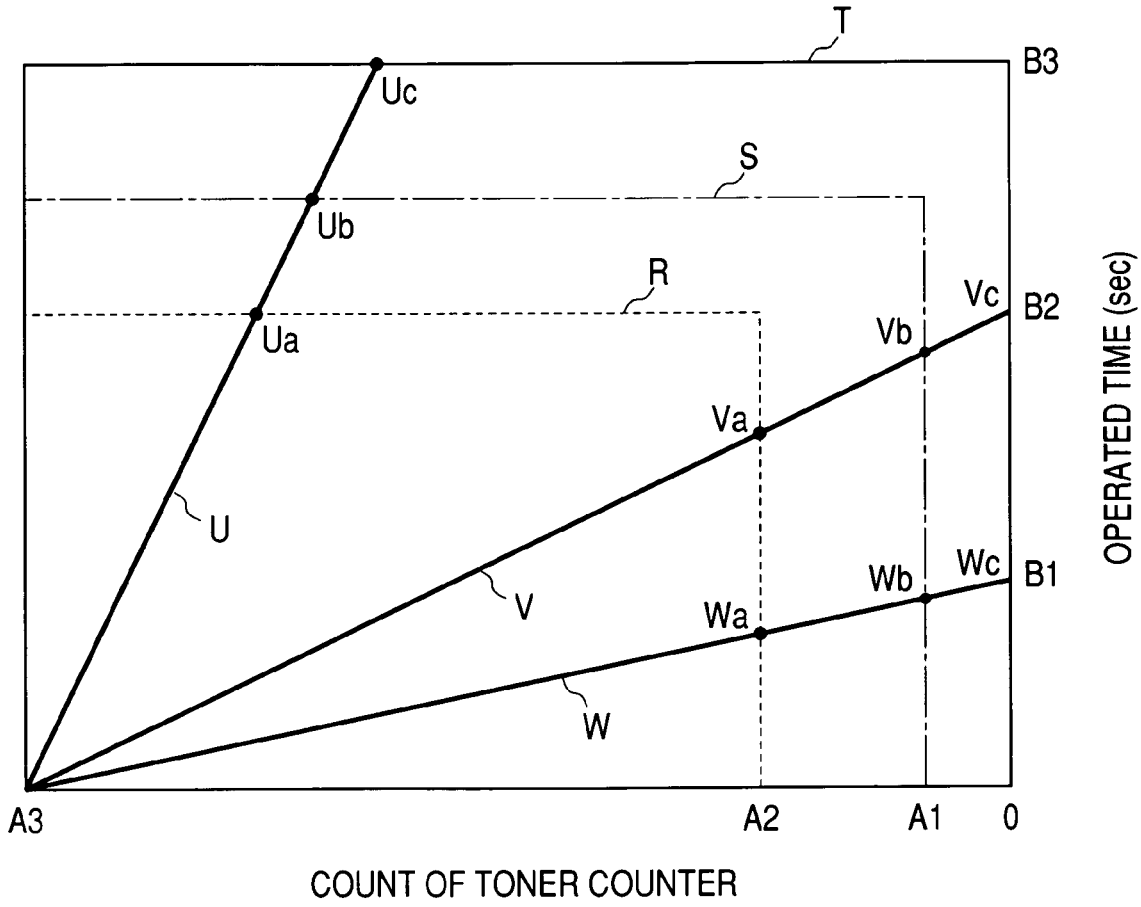
FIGS. 2 and 3 are graphs for explaining how to manage a life of a toner cartridge.

In FIG. 2, a count of the toner counter is set on the horizontal axis, and an operated time of the development roller (a cumulative time [sec]) is set on the vertical axis. In connection with the count of the toner counter, a maximum of 130,000,000 is set as an example count in the case of a large toner cartridge which enables formation of images on 6000 sheets of A4-size paper. Moreover, in the case of a small toner cartridge which is to be loaded in the same image forming apparatus and enables formation of images on 2000 sheets of A4-sized paper, the count of the toner counter is set to a maximum of 5,000,000. According to the present invention, regardless of the toner cartridge used, the large toner cartridge or the small toner cartridge, the life of the toner cartridge can be managed appropriately.

In the case of the large toner cartridge, the operated time of the development roller set on the vertical axis is set to a maximum of, e.g., 12,000 sec. Moreover, in the case of the small toner cartridge, the operated time of the development roller is set to a maximum time of, e.g., 4,000 sec. The life of the toner cartridge is determined on the basis of whether or not any of parameters; that is, whether or not the count of the toner counter set on the horizontal axis and the operated time of the development roller set on the vertical axis, has reached a preset value. Specifically, the life of the toner cartridge is determined on the basis of a logical OR value in relation to which of the count of the toner counter and the operated time of the development roller has reached the preset value.

In the embodiment shown in FIG. 2, three levels are set according to the amount of remaining toner at the time of determination of the life of such a toner cartridge. Specifically, the levels are set in decreasing sequence of the amount of remaining toner; that is, (1) a near-end level, (2) an end level, and (3) an end—end level, from the largest amount to smaller amounts. When the amount of remaining toner has decreased from the initial value and reached the (1) near-end level, a warning message "Only a small amount of toner remains" or "The toner cartridge must be replaced soon" is displayed on the display 12.

When the amount of remaining toner has further decreased from (1) near-end level and reached (2) end level, an operation call "Please replace the toner cartridge" is displayed on the display 12. The image forming apparatus may be imparted with the function of displaying the operation call every time an image is formed on one sheet, to thus hinder consecutive formation of images. When the amount of remaining toner has reached (3) end—end level as a result of a further decrease in the amount of remaining toner, control operation is performed such that no image can be formed on the sheet. Therefore, the user can ascertain the time for replacement of a toner cartridge stepwise, and hence superior convenience is achieved, whereby the user's convenience can be enhanced.

In FIG. 2, a dashed line R designates a near-end level; a chain line S designates an end level; and a solid line T designates an end—end level. The count of the toner counter set on the horizontal axis is set to the maximum value A3, the near-end value A2, and the end value A1. Further, the operated time of the development roller set on the vertical axis is set to the maximum (end—end) level B3, the end level B2, and the near-end level B1.

The count of the toner counter is set by the number of pieces (sheets) of recording paper on which images are to be formed and the size of an image formation area on a sheet (i.e., an image occupation ratio). Specifically, the count of the toner counter varies according to the total amount of images formed on a sheet. In FIG. 2, U designates a characteristic achieved at an image occupation ratio of 1%; V designates a characteristic achieved at an image occupation ratio of 5%; and W designates a characteristic achieved at an image occupation ratio of 20%. The characteristic U is assumed to form images on four A4-sized sheets per job; and the other characteristics V, W are assumed to form images for one A4-sized sheet per job. As can be seen from FIG. 2, there is a tendency toward the higher the image occupation ratio, the higher the count of the toner counter and the smaller the amount of remaining toner.

In the embodiment, the near-end value A2 is achieved at 6400 (Ua) sheets in the case of the characteristic U achieved at the image occupation ratio of 1%; 4800 sheets (Va) in the case of the characteristic V achieved at the image occupation ratio of 5%; and 1200 sheets (Wa) in the case of the characteristic W achieved at the image occupation ratio of 20%. The end value A1 is achieved at 8000 (Ub) sheets in the case of the characteristic U achieved at the image occupation ratio of 1%; 6000 sheets (Vb) in the case of the characteristic V achieved at the image occupation ratio of 5%; and 1500 sheets (Wb) in the case of the characteristic W achieved at the image occupation ratio of 20%. Moreover, the end—end level is achieved at 9090 (Uc) sheets in the case of the characteristic U; 6800 sheets (Vc) in the case of the characteristic V; and 1700 sheets (Wc) in the case of the characteristic W. As mentioned above, in the case of the characteristic U achieved at the image occupation ratio of 1% in the embodiment shown in FIG. 2, a 20% difference exists between 6400 sheets (Ua) and 8000 sheets (Ub). Further, a difference of 1090 between 8000 sheets (Ub) and the 9090 sheets (Uc) exists between the near-end A1 and the end. Moreover, in the case of the characteristic V having an image occupation ratio of 5%, a difference of 20% between 4,800 sheets (Va) and 6,000 sheets (Vb) exists between the near-end A2 and the end A1. Moreover, a difference of 800 sheets between 6000 sheets (Vb) and 6.800 sheets (Vc) is present between the end A1 and the end—end.

In relation to the operated time of the development roller set on the vertical axis, the maximum (end—end) level B3, the end level B2, and the near-end level B1 are set for each of the characteristics U, V, and W. For instance, the end—end level B3 of the characteristic U assumes a value of 12,000 sec. An appropriate near-end level and an appropriate end level are set in correspondence with the end—end level for each of the characteristics U, V, and W. In connection with determination of the life of the toner cartridge depending on the operated time of the development roller, it can be seen that the life of the toner cartridge tends to become shorter as the image occupation ratio becomes smaller. Specifically, at a given image occupation ratio the count of the toner counter and the operated time of the development roller are contrary in characteristic to each other in terms of the life of the toner cartridge. As mentioned previously, the life of the toner cartridge can be determined in terms of whether the count of the toner counter or the operated time of the development roller has reached a predetermined level. In the present embodiment, the configuration of the present invention will be described hereinbelow.

Figure 3:
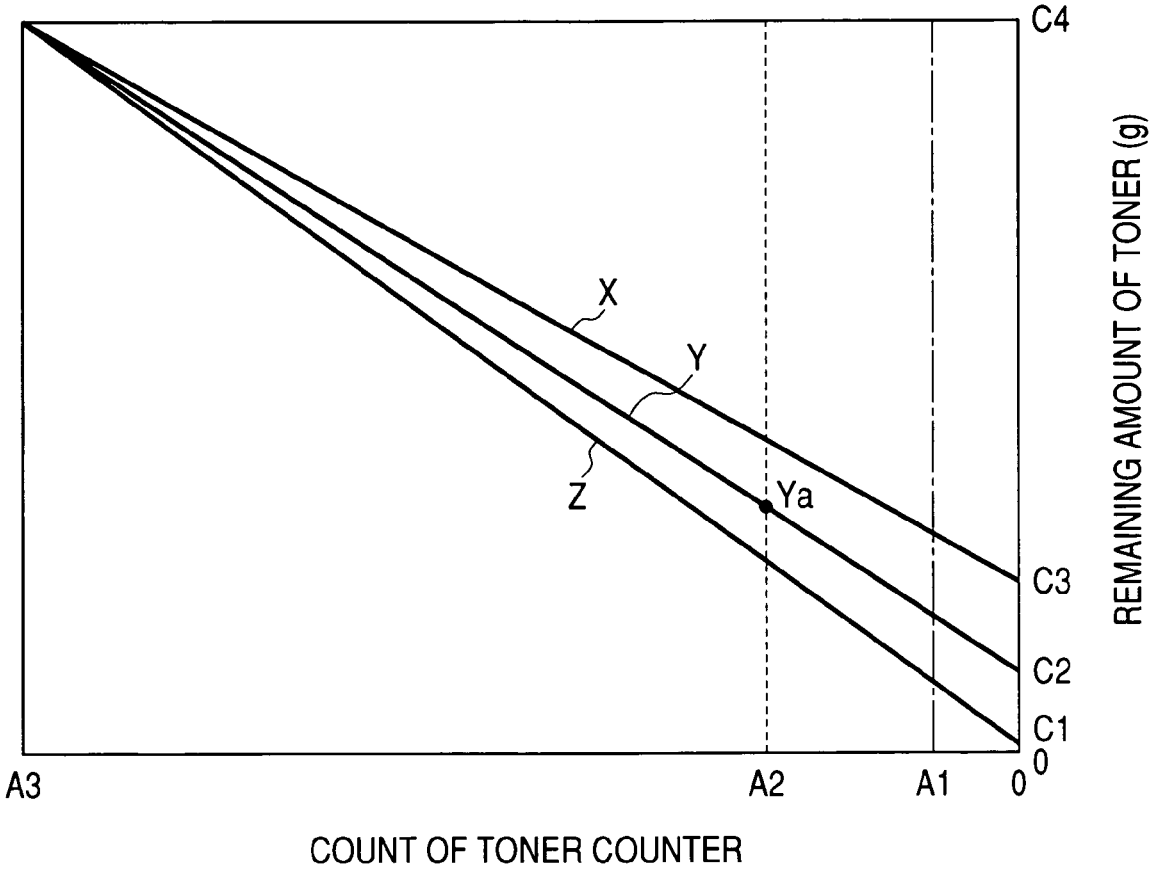

FIG. 3 is a characteristic drawing showing the relationship between the count of the toner counter and the amount of remaining toner. The count of the toner counter is set on the horizontal axis, and the amount of remaining toner (g) is set on the vertical axis. Even in this case, a characteristic achieved by the large cartridge changes from that achieved by the small cartridge. FIG. 3 shows the characteristic of, e.g., the large toner cartridge, which is intended for a case where an image is formed on an A4-sized sheet at an image occupation ratio of 5%. In the embodiment shown in FIG. 3, a standard value and a numerical value which falls within ±12.5% of the standard value are set as a toner-end level. The characteristic Y designates a standard amount of remaining toner; the characteristic X designates +12.5% of the standard amount; and the characteristic Z designates −12.5% of the standard amount. In FIG. 3, an initial value C4 of the amount of toner is set to, e.g., 225 g. Moreover, the standard end value C2 of the amount of remaining toner is set to 54 g; an end value C3 achieved by the characteristic X is set to 79 g; and an end value C1 achieved at the characteristic Z is set to 30 g.

The maximum value A3, the near-end value A2, and the end value A1, which are the same as those shown in FIG. 2, are set on the horizontal axis. A near-end value Ya of a standard characteristic Y assumes a value of 83 g in this embodiment. In the present invention, the count of the toner counter used at the time of determination of the amount of remaining toner at a near-end position is set in conformity with realities of formation of images in respective colors. At this time, in relation to a single color, a near-end value of the amount of remaining toner set for a large toner cartridge differs from that set for a small toner cartridge.

FIG. 4 is a descriptive view showing an example table into which offset values, representing the amount of toner per second of the time during which toner cartridges are in operation, are set previously. The offset values are set in correspondence with the amount of toner consumed in a non-image formation area. Such a table is stored in, e.g., the memory 107 shown in FIG. 9. As mentioned previously, an FRAM may be used as the memory 107. In FIG. 4, the column "color" distinguishes among black (K), cyan (C), magenta (M), and yellow (Y). The column "offset value" lists offset values representing the amount of toner per second of an operated time of the toner cartridges of respective colors. The offset values are set in FIG. 4, and hence the amount of toner consumed in the non-image formation area can be calculated with high accuracy. Further, a real amount of toner consumed at the time of operation of the image forming apparatus can be reflected on the amount of toner consumption.

In FIG. 4, for instance, a1 is set to 205; a2 is set to 199; a3 is set to 153; and a4 is set to 195. These numerical values are set appropriately at the time of driving of the toner cartridges, in consideration of the amount of toner of the respective color consumed by fogging per second of operated time. The total amount of offset values is determined, by multiplying the offset values shown in FIG. 4 by an accumulated time every time the accumulated operated time of the development rollers of respective colors; that is, the accumulated operated time of the toner cartridges, have reached a predetermined value. The total amount of toner consumption is calculated by addition of the thus-determined all offset values. Therefore, the offset value is determined in correspondence with the operated time of the toner cartridge, thereby calculating the total amount of toner consumption. Therefore, the amount of toner consumption of each color can be determined accurately. Moreover, use of the thus-determined amount of toner consumption enables accurate management of the life of the toner cartridges.

In another example, the table shown in FIG. 4 can be configured such that the table is used for previously setting an offset value of the amount of toner consumed by a patch image including a solid patch (Vds patch) and a fine-line patch (E patch). The offset value employed in this case is set in correspondence with the amount of toner consumed by the patch image. Therefore, offset values of patch images of respective colors are set in the column "offset value" shown in FIG. 4. In a case where the offset value regarding the amount of toner consumed by the patch image is set, the amount of toner consumed in a preparing step prior to formation of an image in the image formation area is added to the amount of toner consumed by formation of an image in the image formation area, whereby the total amount of toner to be consumed during operation of the image forming apparatus can be calculated accurately, to thus reflect realities on the amount of toner consumption.

When offset values pertaining to the amount of toner consumed by the patch image are set, a1 is set to 4641; a2 is set to 4911; a3 is set to 4945; and a4 is set to 4026 in the table shown in FIG. 4. These numerical values are appropriately set at the time of formation of a patch image in consideration of the amounts of consumed toner of respective colors. The total amount of toner consumption is calculated by addition of the thus-determined offset values of the patch image. Therefore, the amount of toner consumption of each color can be determined accurately. Moreover, use of the thus-determined amount of toner consumption enables accurate management of the life of the toner cartridges.

There will now be described still another example in which the table shown in FIG. 4 can be used as a table for previously setting offset values pertaining to the amount of toner consumed as a result of the toner being imparted to predetermined locations for rendering image quality stable. The amount of toner consumed for rendering image quality stable corresponds to, e.g., the amount of toner consumed at the time of formation of a registration mark. In this case, offset values a1 to a4 pertaining to the amount of toner consumed at the time of formation of registration marks in respective colors are set in the column "offset value" shown in FIG. 4. Since the offset values a1 to a4 are set in the manner mentioned above, the amount of toner consumed as a result of toner being imparted for rendering image quality stable is added to the amount of toner consumed by forming an image in the image formation area, thereby enabling accurate calculation of the total amount of toner consumed during the course of operation of the image forming apparatus, thereby enabling reflection of realities on the amount of toner consumption. Moreover, the life of the ink cartridges can be managed accurately.

By way of an example, for instance, a1 is set to 52×N; a2 is set to 0; a3 is set to 0; and a4 is set to 0. In this embodiment, the registration mark is formed from the black (K) toner. Here, N denotes a constant set according to the size of a recording medium (i.e., a paper size). For instance N is set to five when the paper size is A4 or more; N is set to four at a paper size of B4; N is set to three from the size of a postcard to B5 size; N is set to two at the size of the postcard; and N is set to one at a size smaller than the postcard.

FIG. 5 shows a table showing offset values b1 to b4 pertaining to the amount of toner provided in the vicinity of an area where the cleaning blade comes into contact with the photosensitive member at the time of shipment of an image forming apparatus for preventing vibration of the cleaning blade. Even in this embodiment, the offset values b1 to b4 are set for respective colors. By way of an example, b1 is set to 10974, and b2 to b4 are set to 0. Specifically, black (K) is used for toner to be imparted for preventing vibration of a cleaning blade. In the embodiment shown in FIG. 5, the amount of toner imparted for preventing vibration of the cleaning blade is added in the form of offset values, whereby the total amount of toner consumption is calculated. Therefore, for the respective colors the amount of toner consumption can be determined accurately. Use of the thus-determined toner consumption enables accurate management of the life of the toner cartridges.

FIG. 6 is a descriptive view showing another example table in which offset values pertaining to the amount of toner consumed by the patch image are set beforehand. In FIG. 6, the column "color" distinguishes among black (K), cyan (C), magenta (M), and yellow (Y). Set in the column "offset value" are first offset values of gradation patches of respective colors prepared by the main controller 11 and second offset values of patch images of respective colors prepared by the engine controller 10. The patch images prepared by the engine controller 10 include mere solid patches (Vdc patches) or a combination of solid patches and fine-line patches (E patches). For the sake of simplicity, the table shown in FIG. 6 summarizes the offset values in a single table. However, the offset values of the gradation patch are actually stored in storage of the main controller 11 omitted from FIG. 9 separately from the offset values of the solid and fine-line patches stored in the memory 107 shown in FIG. 9. The offset values are set in correspondence with the amount of toner consumed by the patch images.

As mentioned above, the offset values pertaining to the toner consumed by preparation of the patch images are set for respective colors in the example shown in FIG. 6. Therefore, the amount of toner consumed in a preparing step prior to formation of an image in the image formation area is added to the amount of toner consumed by formation of an image in the image formation area, whereby the total amount of toner to be consumed during operation of the image forming apparatus can be calculated accurately, to thus reflect realities on the amount of toner consumption.

In the example shown in FIG. 6, on the assumption that the maximum count of the toner counter is set to 13,000,000, for instance, a1 is set to 4641; a2 is set to 4911; a3 is set to 4945; and a4 is set to 4026. Further, b1 is set to 830; b2 is set to 869; b3 is set to 872; and b4 is set to 713. At the time of formation of the patch images, these numerals are set appropriately in consideration of realities of the amount of toner consumption for the respective colors. In the embodiment, the total amount of toner consumption is calculated by addition of the thus-obtained offset values of the patch images. Therefore, the amount of toner consumption for the respective colors can be determined accurately. Further, use of the thus-determined toner consumption enables accurate management of the life of the toner cartridges of the respective colors.

In the embodiment, the offset values of the gradation patches prepared by the main controller 11 are stored in the storage of the main controller 11. Moreover, the offset value of the solid path and that of the fine-line patch, which are prepared by the engine controller 10, are stored in the storage of the engine controller 10. Therefore, since the offset values are stored in the different storages, even if a failure has arisen in the main controller 11 or the engine controller 10, the risk of simultaneous loss of data from both the main and engine controllers will become low. For this reason, enhanced security is achieved at the time of storage of the offset values pertaining to the amount of toner consumed by the patch images in the storage.

Figure 1:
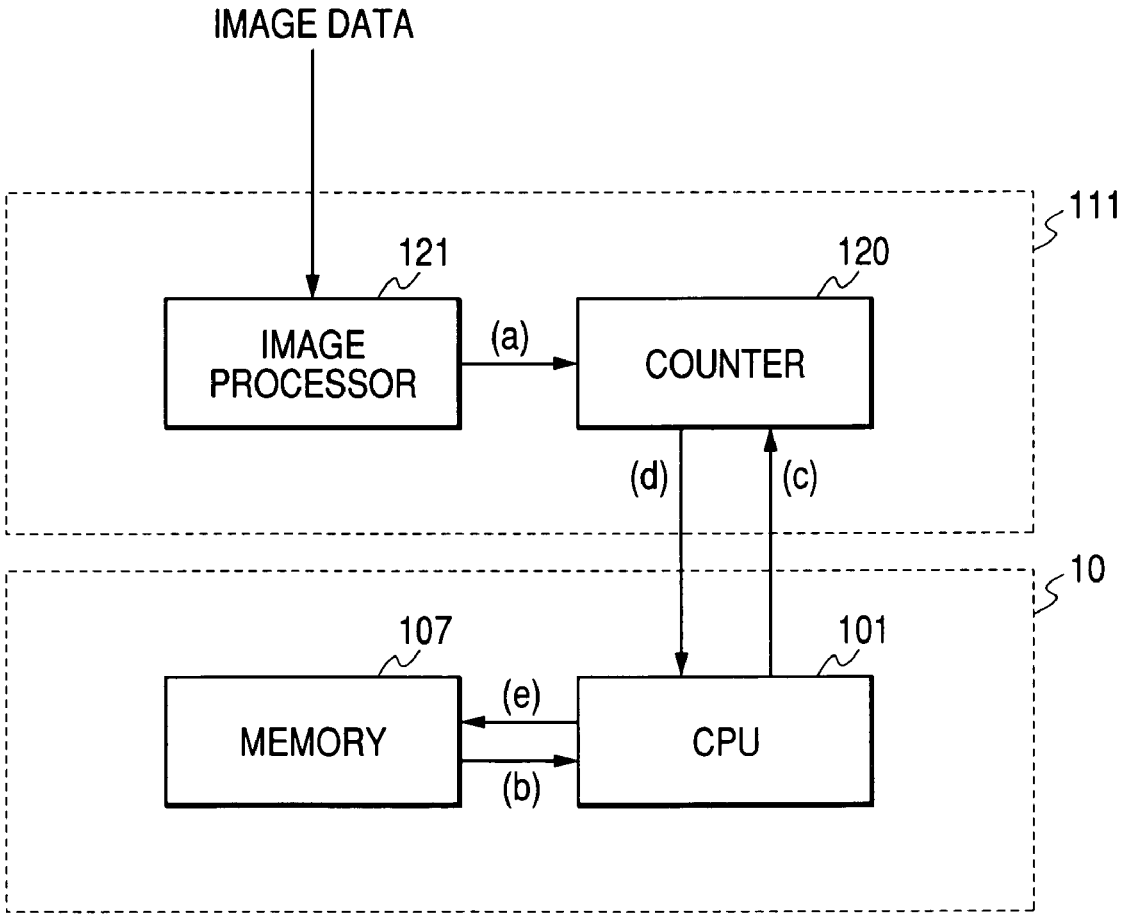
FIG. 1 is a block diagram showing an essential part of the toner consumption calculator according to one embodiment of the present invention.

FIG. 1 is a fragmentary enlarged view of the block diagram shown in FIG. 9. In this apparatus, the engine controller 10 commences its operation on the basis of the program stored in the ROM 16 (FIG. 9), and the CPU 111 of the main controller 11 operates. The CPU 111 is provided with a counter 120 and an image processor 121. The toner counter is constituted in the CPU 101 of the engine controller 10 in the form of software or hardware. When the image data output from an external apparatus are input to the image processor 121, the image processor 121 produces an exposure signal (a) and inputs the thus-produced signal to the counter 120. By the exposure signal (a), the counter 120 counts the number of pixels on a per-color basis and on a per-page basis and sends the resultant count (d) to the CPU 101. At this time, the offset values pertaining to the amount of toner consumed by the gradation patch image stored in the storage of the main controller 11 may also be transmitted to the CPU 101 along with the count (d).

The CPU 101 of the engine controller 10 reads, from the memory 107, initial values and coefficients, both pertaining to the initial amount of toner filled in the toner cartridges of respective colors, and offset values associated with the operated time of the toner cartridge (b). The memory 107 serves as a storage for previously storing the amount of toner consumed by the non-image formation section as an offset value. An offset value pertaining to the amount of toner consumed by the patch image can also be stored in the memory 107. In this case, the memory 107 serves as a storage for previously storing the amount of toner consumed by the patch image as an offset value.

Moreover, the CPU 101 of the engine controller 10 can also read, from the memory 107, initial values and coefficients, both pertaining to the amount of toner filled in the toner cartridges of respective colors, and offset values associated with the operated time of the toner cartridge (b). In this case, the memory 107 serves as a storage for previously storing the amount of toner consumed by the solid patch image and the fine-line patch image as an offset value. Moreover, the amount of toner consumed by imparting for rendering image quality stable as an offset value in the memory 107.

The coefficient is a weighting coefficient to be employed at the time of formation of an image and will be described in detail later. The CPU 101 transmits to the counter 120 a result of calculation (c), which is obtained by adding a coefficient to the count (d). As mentioned above, the CPU 101 of the engine controller 10 calculates the count for each color and page transmitted from the counter 120 in (d) and a dot count on the basis of the coefficient read from the memory 107; that is, the count of the toner counter (i.e., the amount of toner consumption). The offset value associated with the operated time of the toner cartridge is added to the amount of toner consumption. The amount of toner consumption is subtracted from the former amount of toner, thereby determining a new amount of toner and storing the thus-determined amount (e) into the memory 107. The offset value to be added to the amount of toner consumption can also be taken as an offset value associated with formation of a patch image or an offset value imparted for rendering image quality stable. Formation of a patch image includes formation of various patches, such as a gradation patch, a fine-line patch, or a solid patch.

The table, into which the offset values (shown in FIGS. 4 through 6) are set, is stored in the memory 107. When the new amount of remaining toner is stored in the memory 107, the CPU 101 compares the thus-updated amount of remaining toner with the near-end value. When the amount of remaining toner has already reached the near-end value, a signal for informing an approach to the end of life of the toner cartridge is output. Specifically, the CPU 101 serves as a judge for determining a time at which the toner cartridge is to be replaced. Although omitted from the drawings, the CPU 101 of the engine controller 10 receives a signal pertaining to an operated time input from the timer during the course of operation of the development roller 44. The operated time is accumulated on a per-job basis and stored in the memory 107. When the operated time has reached the near-end value, a message to this effect appears on the display.

There will now be described the configuration and operation of the toner counter with reference to FIG. 10.

In this device, the CPU 101 performs predetermined processing operation on the basis of the program stored in the ROM 106 shown in FIG. 9, thereby determining the amount of toner consumed by the image formation area. Specifically, all the configuration of the toner counter is implemented by software but may also be implemented by hardware. Here, the principle of operation of the toner counter according to the invention will be described while a toner counter 200 having the hardware configuration shown in FIG. 10 is taken as an example. Even when the circuit shown in FIG. 10 is implemented by software, the amount of toner consumption can be determined on the basis of the same principle as that employed in the case of the hardware.

On the basis of a control signal identical with that delivered from the CPU 101 to the exposure controller 102; that is, an image signal input from the external apparatus, a signal converted into a gradation value for each color of toner is input to the toner counter 200. On the basis of the control signal, the comparator 201 permits passage of a signal corresponding to a print dot whose gradation value is equal to or larger than a predetermined threshold value, and the signal is input to a discriminator 202. The discriminator 202 determines the arrangement of print dots on the basis of the signal output from the comparator 201. Specifically, the discriminator 202 detects the number of dots constituting the train of print dots, classifies the dots into three categories; that is, a pattern of dots which are larger than a threshold value; a pattern of four continuous dots; and a pattern of isolated dots, and outputs "1" to any of counters 203 to 205 according to the category. Here, the isolated dots are dots in which adjacent pixels on both sides of a pixel of certain threshold value or more are less than the threshold value. The counters 203, 204, and 205 are provided so as to correspond to the pattern of dots which are larger than a threshold value, the pattern of four continuous dots, and the pattern of isolated dots, respectively. The counters 203 to 205 count the number of times a train of print dots is formed into a pattern of interest, by counting a signal output from the discriminator 202 at any times.

For instance, when the control signal input to the comparator 201 corresponds to the pattern of isolated dots, the discriminator 202 determines the print dots as isolated dots in accordance with the signal output from the comparator 201. The discriminator 202 outputs "1" to the counter 205 but " " to the other counters 203, 204. By such processing, only the count of the counter 205, which shows the number of times the pattern of isolated dots is formed is incremented by one. However, at this time, the counts of the other counters 203, 204 remain unchanged. Similarly, when the control signal input to the comparator 201 corresponds to the pattern of four continuous dots, the count of the corresponding counter 204 is incremented by one. Thus, the number of times the print dots are formed is individually counted on a per-pattern basis.

The counts C1, C2, and C3 are input to a calculator 206. In addition to the count values C1, C2, and C3, offset values "No" for respective colors output from the CPU 101 and an output from a coefficient table 207 are input to the calculator 206. An output from the calculator 206 is input to the CPU 101 and the coefficient table 207. The coefficient table 207 stores a plurality of sets of numerals, which would be candidates for "weighting coefficients" Kx, K1, K2, and K3 (see Equation 1 provided below), beforehand, and any one is selected from the sets in accordance with an output from the calculator 206. Here, the offset value No differs from the offset value associated with the operated time of the toner cartridge. The calculator 206 multiplies the counts C1, C2, and C3 output from the respective counters 203 to 205 by the weighting coefficients K1, K2, and K3 selectively output from the coefficient table 207, as well as summating them.

Although omitted form the drawings, the offset values associated with the operated time of the toner cartridge described in connection with FIG. 4 are read from the memory 107, and the thus-read offset values are input to the calculator 206. The offset value No output from the CPU 101 is added to a product of the sum and the coefficient Kx. Through the foregoing calculations defined by Equation (1), the amount of toner consumption Ct (first amount of toner consumption) is determined.

$$Ct=Kx\cdot(K1\cdot C1+K2\cdot C2+K3\cdot C3)+No \quad (1)$$

Here, Kx designates a color dependence coefficient which changes from color to color.

The CPU 101 transmits, to the counter 210, the operated time of the toner cartridge counted by the program counter in the manner as mentioned previously and counts the accumulated operated time of the toner cartridge. The calculator 206 multiplies the accumulated operated time of the toner cartridge by the offset value associated with the operated time of the toner cartridge every time the operated time of the toner cartridge counted by the counter 210 reaches a predetermined value, thereby calculating the second amount of toner consumed by the non-image formation section. The thus-calculated second amount of toner consumed by the non-image formation section is added to the first amount of toner consumption Ct, thereby determining the total amount of toner consumption (i.e., third amount of toner consumption). The accumulated operated time of the toner cartridge can be set for every time, for example, an image is formed on one recording medium.

As mentioned previously, in the embodiment, all the functions of the toner counter 200 are implemented as software. Such a configuration obviates a necessity for adding special hardware for addition of the amount of toner consumption and renders the configuration of the image forming apparatus simple, thereby curtailing costs of the apparatus.

Figure 10:
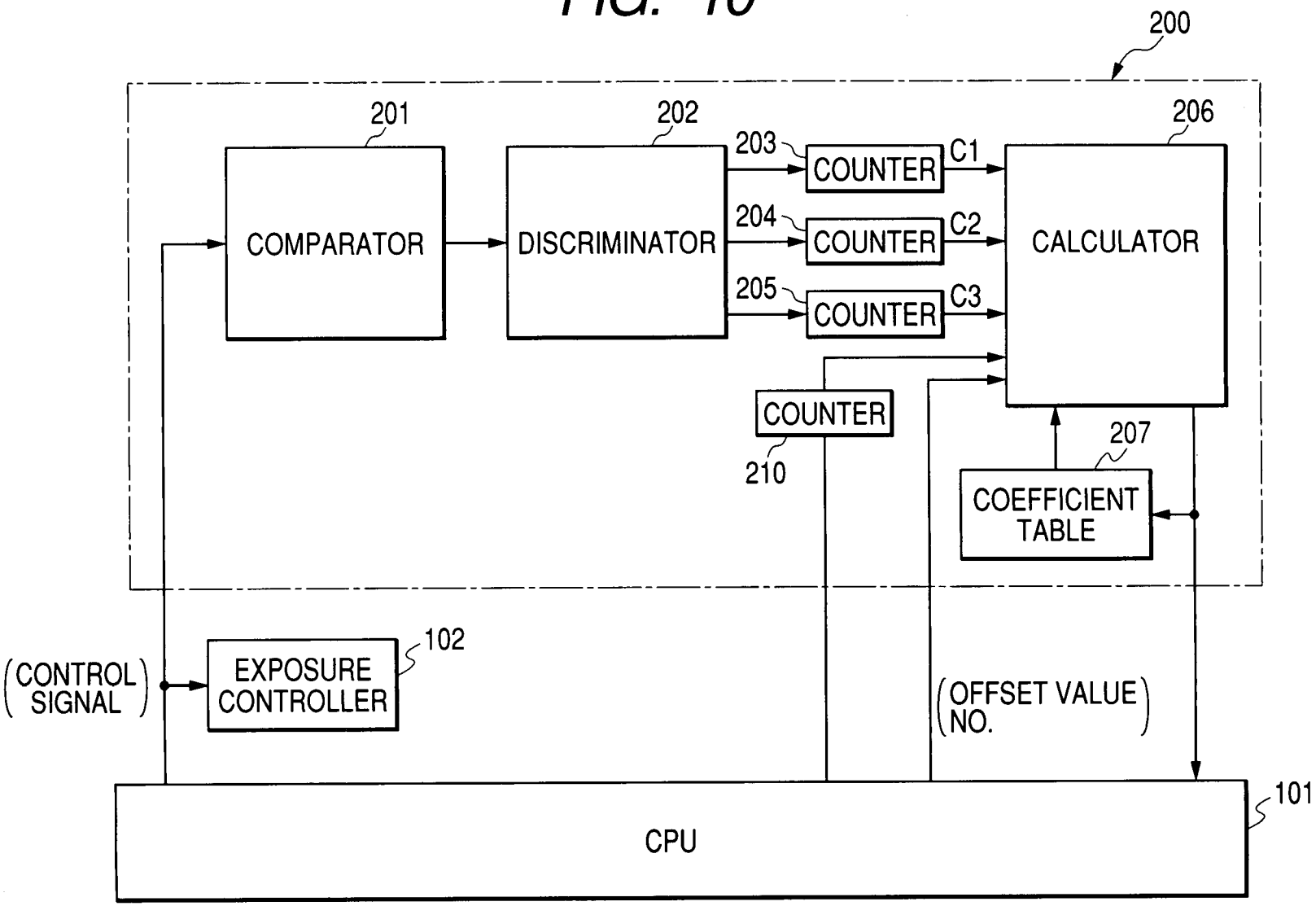
FIG. 10 is a block diagram showing a toner counter in the image forming apparatus of FIG. 7.
Figure 11:
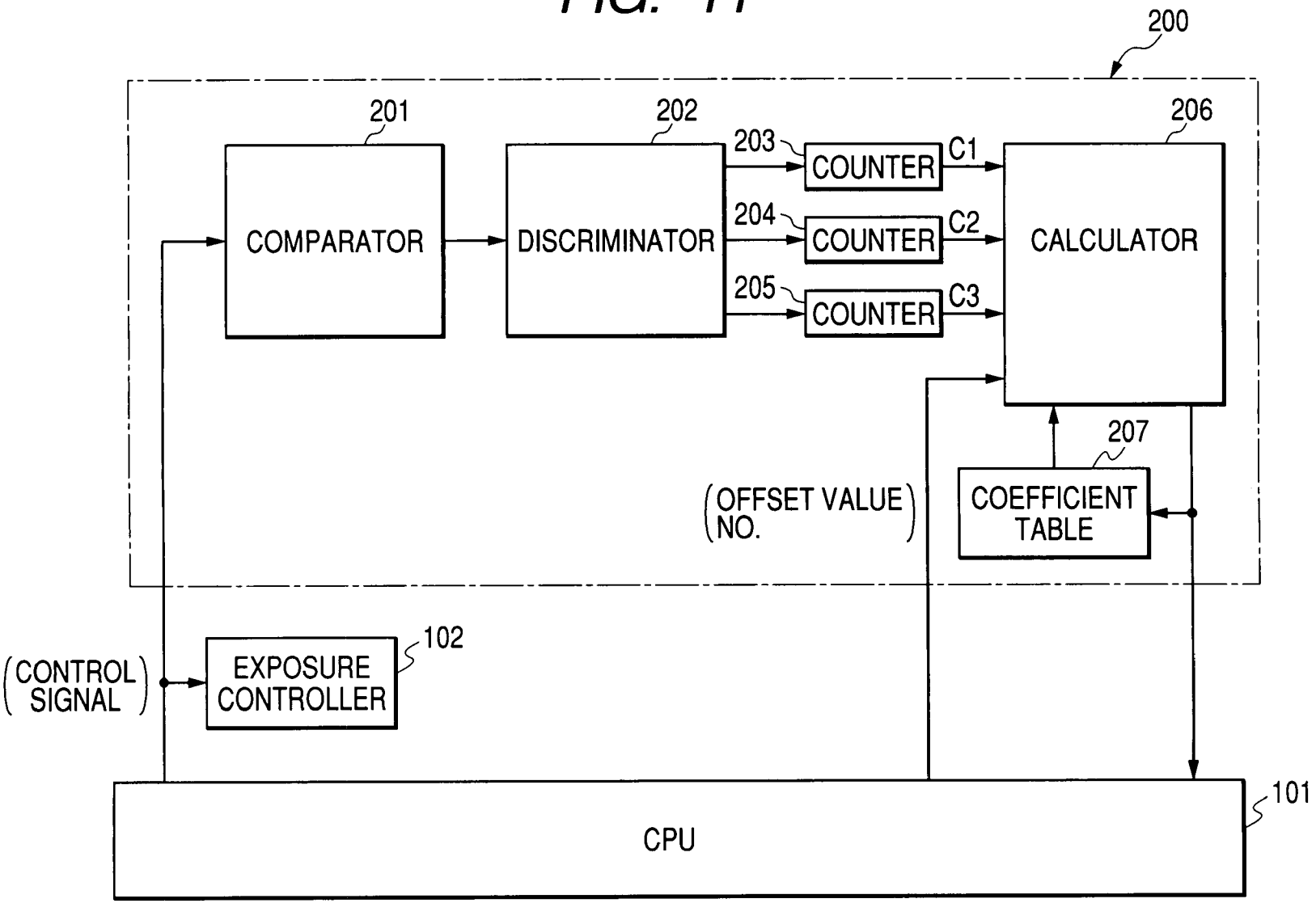
FIG. 11 is a block diagram showing a modified example of the toner counter of FIG. 10.

Further, the counter 210 shown in FIG. 10 may be omitted, in which case the offset value associated with the operated time of the toner cartridge per second is sequentially added, thereby calculating the total amount of toner consumption. FIG. 11 is a block diagram showing such an example. In this case, there is not performed any operation for counting the accumulated operated time of the toner cartridge from the operated time of the toner cartridge counted by the program timer. Specifically, every time the accumulated operated time of the toner cartridge reaches a predetermined value, the accumulated operated time of the toner cartridge is multiplied by the offset value associated with the operated time of the toner cartridge, thereby avoiding calculation of the amount of toner consumed by the non-image formation section. In the embodiment, although omitted from the drawing, the CPU 101 reads, from the memory 107, the offset value (i.e., the second amount of toner consumption) associated with formation of the patch image described in connection with FIG. 4 and inputs the thus-read offset value to the calculator 206.

The CPU 101 may read, from the memory 107, the offset value (i.e., the second amount of toner consumption) of the toner imparted for rendering image quality stable. In this case, the CPU 101 adds the thus-acquired second amount of toner consumption to the first amount of toner consumption Ct, thereby determining the total amount of toner consumption (third amount of toner consumption). Further, the CPU 101 may read, from the memory 107, the offset value associated with formation of the patch image, such as a solid patch. Further, the CPU 101 may add the offset value corresponding to the amount of toner consumed by the gradation patch, the amount being transmitted from the main controller 11, to the offset value read from the memory 107, thereby calculating the second amount of toner consumption. The thus-acquired second amount of toner consumption is added to the first amount of toner consumption Ct, thereby determining the total amount of toner consumption (i.e., the third amount of toner consumption).

As has been described above, according to the present invention, in an image forming apparatus which forms an image on a recording medium in a plurality of colors of toner through use of a rotary developer, the amount of toner consumption can be calculated with high accuracy in keeping with the realities of image forming operation. Even in the image forming apparatus using the intermediate transfer member, the quantity of toner consumption can be calculated with high accuracy.

The foregoing embodiment is directed toward the image forming apparatus configured so as to be able to form a full-color image through use of four colors of toner; that is, yellow toner, cyan toner, magenta toner, and black toner. In terms of the colors of toner to be employed and the number of colors of toner to be employed, the present invention is not limited to the embodiments, and arbitrary colors of toner and numbers of colors can be employed. For instance, the present invention can also be applied to an apparatus which forms a monochrome image through use of, e.g., only black toner. Moreover, the amount of toner consumed by a plurality of developers can be determined individually by a single hardware configuration.

Further, according to the embodiments, the present invention is applied to a printer which performs image forming operation on the basis of an image signal output from an external apparatus. The present invention is not limited solely to such a printer. Needless to say, the present invention can be applied to a copier which prepares an image signal in an apparatus in response to an image forming request from the user; e.g., a user's action of pressing a copy button, and performs an image forming operation in accordance with the image signal or a facsimile apparatus which performs an image forming operation in accordance with an image signal received by way of a communications line.

What is claimed is:

1. A device, for calculating a total amount of toner consumed from a toner cartridge, comprising:

a counter, determining a first amount of the toner consumed in a first region, of a recording medium, in which a toner image is formed;

a first storage, storing an offset value indicating a consumption rate of toner in a second region, of the recording medium, in which the toner image is not formed; and a calculator, determining a second amount of toner consumed, based on said offset value, and determining a total amount of toner consumed based on the first and second amounts.

2. The device as set forth in claim 1, further comprising a timer clocking an operation time period of the toner cartridge;

wherein said offset value is a consumption rate in a specific amount of time; and wherein said second amount of toner consumed is determined based on said offset value and said operation time period.

3. An image forming apparatus comprising:

the device as set forth in claim 1;

a second storage, storing a value relating to a remaining amount of the toner in the toner cartridge, which is calculated based on the determined total amount of toner consumed and an initial amount of the toner in the toner cartridge; and a judge, which judges a time at which the toner cartridge is replaced, in a case where the remaining amount of the toner in the toner cartridge becomes a predetermined value or less.

4. A device, for calculating a total amount of toner consumed from a toner cartridge, comprising:

a counter, determining a first amount of the toner which is consumed in a first region, of a recording medium, in which a toner image is formed;

a first storage, storing a value related to a second amount of the toner consumed by forming a test image; and a calculator, determining the second amount of toner consumed, based on said value stored in the first storage, and determining the total amount of toner based on the first and second amounts.

5. An image forming apparatus comprising:

the device as set forth in claim 4;

a second storage, storing a value relating to a remaining amount of the toner in the toner cartridge, which is calculated based on the determined total amount of toner consumed and an initial amount of the toner in the toner cartridge; and a judge, which judges a time at which the toner cartridge is replaced, in a case where the remaining amount of the toner in the toner cartridge becomes a predetermined value or less.

6. A device, for calculating a total amount of toner consumed from a toner cartridge, comprising:

a counter, determining a first amount of the toner consumed in a first region, of a recording medium, in which a toner image is formed;

a first storage, storing a value related to a second amount of the toner consumed other than in the formation of the toner image on the recording medium; and a calculator, determining the second amount of toner consumed, based on said value stored in the first storage, and determining a total amount of toner consumed based on the first and second amounts.

7. The device as set forth in claim 6, wherein the second amount of the toner includes an amount of toner used for forming a registration mark for placing the recording medium at a predetermined position.

8. The device as set forth in claim 6, wherein the second amount of the toner includes an amount of toner used for stabilizing vibrations of a cleaning blade abutted against a toner carrier.

9. The device as set forth in any one of claims 1 to 6, wherein:

a plurality of colors of toner are used to form the toner image; and the second amount is individually determined for each of the colors.

10. An image forming apparatus comprising:

the device as set forth in claim 6;

a second storage, storing a value relating to a remaining amount of the toner in the toner cartridge, which is calculated based on the determined total amount of toner consumed and an initial amount of the toner in the toner cartridge; and a judge, which judges a time at which the toner cartridge is replaced, in a case where the remaining amount of the toner in the toner cartridge becomes a predetermined value or less.

11. A device for calculating a total amount of toner consumed from a toner cartridge, the device comprising:

a counter, determining a first amount of the toner consumed in a first region, of a recording medium, in which a toner image is formed;

a first storage, storing a first value related to a second amount of the toner consumed for forming a first test image;

a second storage, storing a second value related to a third amount of the toner consumed for forming a second test image; and a calculator, determining the second amount of toner consumed based on said first value, determining the third amount of toner consumed based on said second value, and determining the total amount of toner consumed based on said first, second and third amounts.

12. The device as set forth in claim 11, wherein the first test image is a gradation image, and the second test image includes at least a solid image.

13. The device as set forth in claim 11, wherein:

the first storage is provided in a first controller which receives an image signal from an external device; and the second storage is provided in a second controller which controls the formation of the toner image based on an instruction from the first controller.

14. The device as set forth in claim 11, wherein:

a plurality of colors of toner are used to form the toner image; and the second amount and the third amount are individually determined for each of the colors.

15. An image forming apparatus, comprising:

the device as set forth in claim 11;

a third storage, storing a value relating to a remaining amount of the toner in the toner cartridge, the remaining amount is calculated based on the determined total amount of toner consumed and an initial amount of the toner in the toner cartridge; and a judge, which judges a time at which the toner cartridge is replaced, in a case where the remaining amount becomes a predetermined value or less.

16. The image forming apparatus as set forth in claim 15, wherein the predetermined value is selected from a plurality of values one of which is substantially zero.

17. The image forming apparatus as set forth in claim 15, wherein the predetermined value is varied in accordance with a rate of an area of the toner image relative to the recording medium.

18. The image forming apparatus as set forth in claim 15, wherein the predetermined value is individually determined for each of a plurality of toner cartridges having different volumes.

19. A method, for calculating a total amount of toner consumed from a toner cartridge, comprising steps of:

determining a first amount of the toner consumed in a first region, of a recording medium, in which a toner image is formed;

storing an offset value indicating a consumption rate of toner in a second region of the recording medium at which the toner image is not formed; and determining a second amount of toner consumed based on said offset value, and determining the total amount of toner consumed based on the first and second amounts.

20. The method of claim 19, further comprising clocking an operation time period of the toner cartridge;

wherein said offset value is a consumption rate of toner consumed in a specific amount of time and the second amount of toner consumed is determined based on said offset value and said operation time period.

21. A method, for calculating a total amount of toner consumed from a toner cartridge, comprising steps of:

determining a first amount of the toner consumed in a first region, of a recording medium, in which a toner image is formed;

storing a value relating to a second amount of the toner consumed by forming a test image; and determining the second amount of toner consumed based on said stored value and determining the total amount of toner consumed based on the first and second amounts.

22. A method, for calculating a total amount of toner consumed from a toner cartridge, comprising steps of:

determining a first amount of the toner which is consumed in a first region, of a recording medium, in which a toner image is formed;

storing a value related to a second amount of the toner consumed other than in the formation of the toner image on the recording medium; and determining the second amount of toner consumed based on said stored value and determining the total amount of toner consumed based on the first and second amounts.

23. The method as set forth in claim 22, wherein the second amount of the toner includes an amount of toner used for forming a registration mark for placing the recording medium at a predetermined position.

24. The method as set forth in claim 22, wherein the second amount of the toner includes an amount of toner used for stabilizing vibrations of a cleaning blade abutted against a toner carrier.

25. The method as set forth in any one of claims 19 to 22, wherein:

a plurality of colors of toner are used to form the toner image; and the second amount is individually determined for each of the colors.

26. A method for calculating a total amount of toner consumed from a toner cartridge, the method comprising steps of:

determining a first amount of the toner consumed in a first region, of a recording medium, in which a toner image is formed;

storing a first value, said first value related to a second amount of the toner consumed for forming a first test image;

storing a second value, said second value related to a third amount of the toner consumed for forming a second test image; and determining the second amount of toner based on said first value, determining said third amount of toner based on said second value, and determining the total amount of toner consumed based upon said first, second and third amounts.

27. The method as set forth in claim 26, wherein the first test image is a gradation image, and the second test image includes at least a solid image.

28. The method as set forth in claim 26, wherein:

a plurality of colors of toner are used to form the toner image; and the second amount and the third amount are individually determined for each of the colors.

* * * * *